US011661829B1

(12) United States Patent
Wang et al.

(10) Patent No.: US 11,661,829 B1
(45) Date of Patent: May 30, 2023

(54) SEQUENTIAL INJECTION OF SOLVENT, HOT WATER, AND POLYMER FOR IMPROVING HEAVY OIL RECOVERY

(71) Applicant: SAUDI ARABIAN OIL COMPANY, Dhahran (SA)

(72) Inventors: Jinxun Wang, Dhahran (SA); Abdulkareem M. AlSofi, Dhahran (SA); Saleh F. Hassan, Khobar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/643,134

(22) Filed: Dec. 7, 2021

(51) Int. Cl.
*E21B 43/20* (2006.01)
*E21B 43/24* (2006.01)

(52) U.S. Cl.
CPC ..... *E21B 43/20* (2013.01); *E21B 43/24* (2013.01)

(58) Field of Classification Search
CPC ..... E21B 43/20; E21B 43/24
See application file for complete search history.

(56) References Cited

U.S. PATENT DOCUMENTS 3,587,742 A 6/1971 Wittenwyler et al.
4,127,170 A * 11/1978 Redford ..... E21B 43/24 166/272.3
4,223,730 A 9/1980 Schulz et al.
4,439,334 A 3/1984 Borchardt
5,323,857 A 6/1994 Pirri et al.
7,527,096 B2 5/2009 Chung et al.
8,813,846 B2 * 8/2014 Babadagli ..... E21B 43/2408 166/305.1
10,370,949 B2 * 8/2019 Filatyev ..... E21B 43/305
2010/0300682 A1 12/2010 Thakur et al.
2014/0110305 A1 4/2014 Barnes et al.
2014/0163255 A1 6/2014 Bittner et al.
(Continued)

FOREIGN PATENT DOCUMENTS

WO 2016/081336 A1 5/2016
WO 2020/214789 A1 10/2020

OTHER PUBLICATIONS

Delamaide, E., "Polymer Flooding of Heavy Oil—From Screening to Full-Field Extension", Paper No. SPE-171105-MS, presented at the SPE Heavy and Extra Heavy Oil Conference—Latin America, Medellin, Colombia, Sep. 2014 (30 pages).
(Continued)

*Primary Examiner* — Silvana C Runyan
(74) *Attorney, Agent, or Firm* — Osha Bergman Watanabe & Burton LLP

(57) ABSTRACT

A method for retrieving heavy oil from a reservoir by injection of solvent, hot water, and polymer solution. This method includes the steps of providing an injection well traversing into reservoir containing heavy oil. Sequential injections of solvent, a hot water and polymer solution are performed via the injection well traversing into reservoir containing the heavy oil. The solvent, hot water, and polymer solution intermingle with the heavy oil within the reservoir to form a heavy oil mixture that is retrieved from a production well. The sequential solvent and hot water injection may also be repeated to reduce the viscosity of the heavy oil until an estimated viscosity of the heavy oil in the reservoir is below a threshold viscosity before injecting polymer solution into the reservoir.

17 Claims, 3 Drawing Sheets

(56) References Cited

U.S. PATENT DOCUMENTS

| | | | |
|---|---|---|---|
| 2014/0367097 | A1 | 12/2014 | Milam et al. |
| 2019/0153299 | A1 | 5/2019 | Shong et al. |
| 2019/0345800 | A1 | 11/2019 | Dwarakanath et al. |
| 2020/0031972 | A1 | 1/2020 | Reed et al. |
| 2020/0123889 | A1 | 4/2020 | Subrahmanyan et al. |

OTHER PUBLICATIONS

Firozjaii, AM et al., "Review on Chemical Enhanced Oil Recovery Using Polymer Flooding: Fundamentals, Experimental and Numerical Simulation", Petroleum, vol. 6, Issue 2, pp. 115-122, 2020 (8 pages).

Mohsenzadeh, Adel et al., "Sequential Deep Eutectic Solvent and Steam Injection for Enhanced Heavy Oil Recovery and In-Situ Upgrading", Fuel 187, pp. 417-428, 2017 (12 pages).

Rego, F. et al., "Heavy Oil Recovery by Polymer Flooding and Hot Water Injection Using Numerical Simulation", Journal of Petroleum Science and Engineering, vol. 153, pp. 187-196, 2017 (11 pages).

* cited by examiner

SEQUENTIAL INJECTION OF SOLVENT, HOT WATER, AND POLYMER FOR IMPROVING HEAVY OIL RECOVERY

FIELD OF THE DISCLOSURE

Embodiments of the present disclosure generally relate to enhanced oil recovery using solvent, hot water, and polymer flooding.

BACKGROUND

An oil and gas reservoir is a subsurface formation of rock in which oil and natural gas has accumulated. The oil and gas is usually held in small, connected pore spaces of the subsurface rock and is trapped within the reservoir by overlying impermeable layers of rock. Different types of hydrocarbons may be contained within a reservoir such as natural gas, volatile oil, conventional oil, high pour-point oil, and heavy oil. Heavy oil is a type of oil that is different from conventional oil in that it is much more difficult to recover from a subsurface reservoir. Consequently, up to one-third to one-half of the original heavy oil is left in most reservoirs. However, the rapid rise in global oil demand has generated interest in the recovery of heavy oil. Generally, heavy oil has a higher density, higher viscosity, and lower mobility when compared to conventional oil. The exact definition of heavy oil is not agreed upon by the experts; however, most definitions are based on viscosity, density, and American Petroleum Institute (API) gravity. Heavy oil is usually defined as oil that has a viscosity ranging from 100 to 10,000 mPa*s at reservoir temperature, density ranging from 943 to 1,000 kg/m3, and API gravity of less than 20° or less than 10° API. Density is used to characterize heavy oil only if viscosity measurements are not available.

The resources of global heavy oil are estimated to be more than twice those of conventional light crude oil; however, recovery rates for heavy oil are often limited. There are several challenges and hurdles to the recovery of heavy oil. The extremely high density and viscosity of the heavy oil impedes its ability to flow from the subsurface reservoirs to the production wells under normal reservoir conditions. Current methods attempted or proposed to recover heavy oils include waterflooding, thermal methods and vapor extraction.

SUMMARY OF THE CLAIMED EMBODIMENTS

The following presents a simplified summary of the subject matter disclosed herein in order to provide a basic understanding of some aspects of the information set forth herein. This summary is not an exhaustive overview of the disclosed subject matter. It is not intended to identify key or critical elements of the disclosed subject matter or to delineate the scope of various embodiments disclosed herein. Its sole purpose is to present some concepts in a simplified form as a prelude to the more detailed description that is discussed later.

In one aspect, embodiments disclosed herein relate to a method for retrieving heavy oil from a reservoir where a solvent, hot water, and polymer solution are sequentially introduced via an injection well traversing a subsurface into a reservoir containing a heavy oil. The sequentially introduced solvent, hot water, and polymer solution fluids intermingle with the heavy oil within the reservoir to form a heavy oil mixture that is retrieved from a production well.

In another aspect, embodiments disclosed herein relate to a method for retrieving heavy oil from a reservoir where a solvent and hot water are sequentially introduced via an injection well traversing a subsurface into a reservoir containing a heavy oil. The viscosity of the heavy oil in the reservoir is estimated based on solvent type, injection volume of solvent, temperature and volume of the hot water, and temperature of the reservoir. Repeating the sequential introduction of a solvent and hot water and estimating the viscosity of the heavy oil in the reservoir is performed until the viscosity is estimated to be below a threshold viscosity and thereafter introducing a polymer solution into the reservoir via the injection well. The sequentially introduced solvent, hot water, and polymer solution fluids intermingle with the heavy oil within the reservoir to form a heavy oil mixture that is retrieved from a production well (interact with the heavy oil to decrease a viscosity of the heavy oil and forming a heavy oil mixture that is retrieved from the production well).

Other aspects and advantages will be apparent from the following description and the appended claims.

BRIEF DESCRIPTION OF DRAWINGS

Certain aspects of the presently disclosed subject matter will be described with reference to the accompanying drawings, which are representative and schematic in nature and are not to be considered to be limiting in any respect as it relates to the scope of the subject matter disclosed herein.

Figure 1:
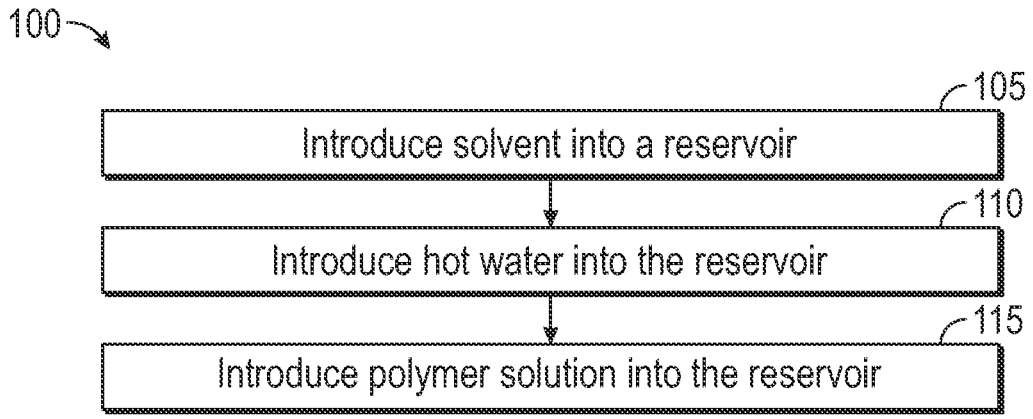
FIG. 1 illustrates a flowchart depicting a sequential method to recover heavy oil according to one or more embodiments.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the disclosed subject matter to the particular forms disclosed, but on the contrary, the intention is to cover all modifications, equivalents, and alternatives falling within the spirit and scope of the disclosed subject matter as defined by the appended claims.

Typically, down is toward or at the bottom and up is toward or at the top of the figure. "Up" and "down" are oriented relative to a local vertical direction. However, in the oil and gas industry, one or more activity may take place in deviated or horizontal wells. Therefore, one or more figure may represent an activity in vertical, approximately vertical, deviated, approximately horizontal, or horizontal wellbore configuration.

DETAILED DESCRIPTION

Several methods used to recover heavy oil from subsurface reservoirs have been attempted but these methods have disadvantages.

Waterflooding is recognized as a cost-effective oil recovery technique for conventional oil production. However, waterflooding for heavy oil reservoir achieves very low oil recovery due to the large viscosity contrast between the water and the heavy oil, and hence the poor mobility ratio.

Thermal methods can effectively lower the viscosity of heavy oil; thus, increasing the mobility of oil. The most commonly used thermal methods include steam-based techniques. These include steam flooding, steam assisted gravity drainage (SAGD) and cyclic steam stimulation (CSS). However, the steam injections have limited applications because they are not effective in several reservoir formations, such as thin reservoirs and deep reservoirs.

A non-thermal method for heavy oil recovery known as vapor extraction (VAPEX), is also proposed in the literature. In this method, a solvent vapor is used to dilute the heavy oil and then produce the heavy oil by gravity drainage. However, the vapor diffusion process takes a very long time and therefore is not cost effective.

Polymer flooding is also used to improve the mobility ratio during the recovery of heavy oil, but very high concentrations of polymer solution may be required to measurably decrease the mobility ratio. This not only increases the difficulty of injection but also adds to the costs of chemicals, making the process very expensive.

Various illustrative embodiments of the disclosed subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present subject matter will now be described with reference to the attached figures. Various structures, systems and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase. With reference to the attached figures, various illustrative embodiments of the systems, devices and method disclosed herein will now be described in more detail.

In one or more embodiments, an integrated flooding method to improve and enhance the recovery of heavy oil from a subsurface reservoir is utilized. FIG. 1 shows a flow chart of the integrated method 100 that involves a sequential introduction of solvent into a reservoir 105. The introduction of solvent into a reservoir 105 is followed by the sequential introduction of hot water into the reservoir 110. The introduction of hot water into the reservoir 110 is followed by the sequential introduction of polymer solution into the reservoir 115.

The mobility of the heavy oil is extremely low due to its high viscosity. Viscosity is a property of fluids and slurries that indicates their resistance to flow, defined as the ratio of shear stress to shear rate. This resistance to the flow of the viscous heavy oil may cause difficulties in its production and may determine the success or failure of an oil recovery method. As such, viscosity is also a key parameter for performing simulations and determining the economic viability of an oil recovery project. In step 110, a solvent is introduced to a reservoir to reduce the viscosity of the heavy oil.

A substance or chemical that reduces the viscosity of the reservoir oil is known as a solvent. A solvent is usually a fluid miscible with the reservoir oil and intermixes with it. The solvent may be introduced into a reservoir by injection from a drilling site, such as via an injection well. After injection, the solvent will travel through the subsurface formations and come into contact with the heavy oil located in the subsurface reservoir. The subsurface formations may comprise matrix materials including, but not limited to, limestone, sandstone, and shale, for example. When the viscosity of the heavy oil is reduced, the heavy oil will have enhanced mobility and will move through the formation and towards a production well. This will increase production of heavy oil from the production well and increase the efficiency of heavy oil recovery. However, as mentioned, heavy oil is very viscous and additional steps are performed as part of the integrated method to further increase production of the heavy oil.

Many solvents that lower the viscosity and effectively dilute heavy oils may be used in this method. In one or more embodiments, the solvents used to reduce the viscosity, and increase recovery, are normal hydrocarbons such as pentane, hexane, and heptane. In one or more embodiments, the solvents used to reduce the viscosity and increase recovery are low molecular weight paraffinic hydrocarbons such as naphtha, kerosene, and diesel. Aromatic solvents such as toluene may also be used to reduce the viscosity. In one or more embodiments, the solvents used to reduce the viscosity and increase recovery of heavy oil may include or additionally include middle carbon alcohols such as butanol, pentanol, and hexanol. In one or more embodiments, the solvent used for heavy oil recovery may be in a mixture comprising one or more co-solvents, such as the solvents listed above. The choice of solvent to be used may be influenced by the estimated properties (viscosity, H:C ratio, among others) of the heavy oil within the formation.

In an experiment, the viscosity of a heavy oil sample was measured after mixing the heavy oil with solvents over a temperature range. The heavy oil sample used for the experiment was obtained from a carbonate formation from an oil reservoir. Two solvents were tested in the experiment: a normal hydrocarbon solvent, hexane; and an aromatic solvent, toluene. The two solvents were added to the heavy oil sample to form a mixture of a solvent and heavy oil. Three sample were set up containing: (1) 100 percent heavy oil by weight percentage (wt. %); (2) 90 wt. % heavy oil and 10 wt. % hexane; and (3) 90 wt. % heavy oil and 10 wt. % toluene. The viscosity of the samples was measured by Anton Paar rheometer at a shear rate of 6.81 $s^{-1}$. Viscosity measurements of the heavy oil sample and the mixtures of heavy oil and two solvents were taken over a temperature range. Viscosity may be measured in units of centipoise. A centipoise is considered the standard unit of measurement for fluids and is one-hundredth of a poise. A centipoise relates the amount of force necessary to move a layer of liquid in relation to another liquid. For comparison, the measurement of water is the baseline for all fluids and is 1 centipoise.

Figure 2:
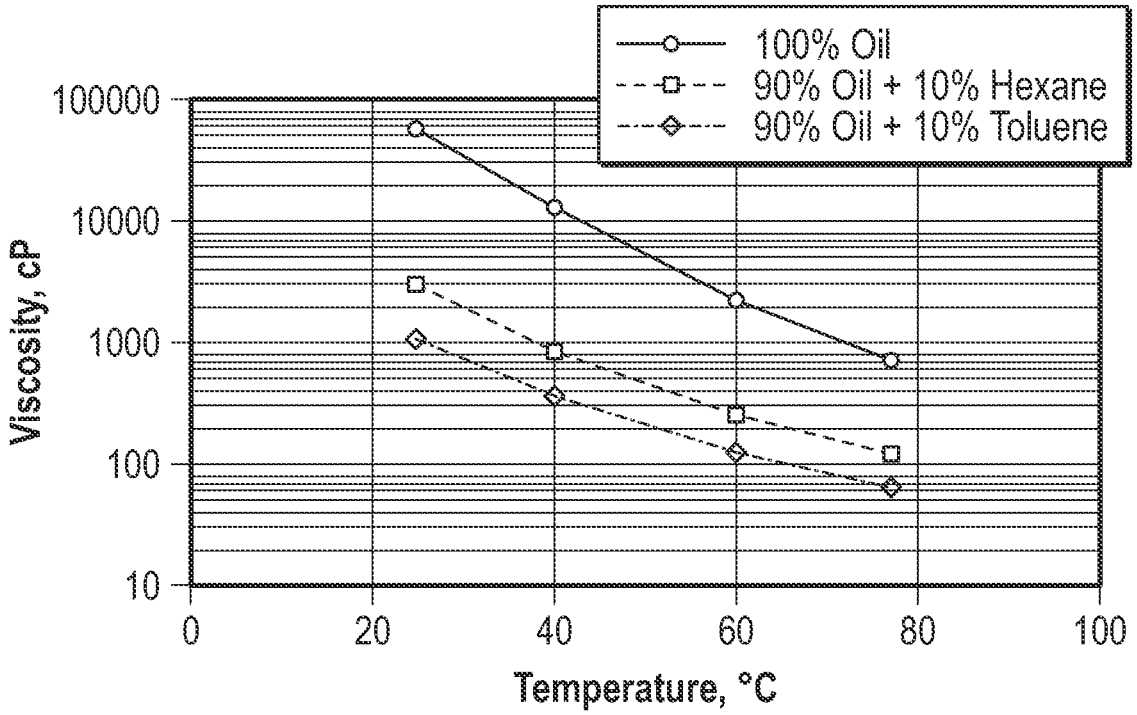
FIG. 2 illustrates a graph showing oil viscosity versus temperature for two solvents according to one or more embodiments.

FIG. 2 illustrates the viscosity measurements of the three sample versus the temperature. At a temperature of 77 Celsius (° C.), the measured viscosity of the sample containing 100 wt. % heavy oil was 711 Centipoises (cP). At a temperature of 77° C., when the heavy oil sample was mixed with hexane to form a sample containing 90 wt. % heavy oil and 10 wt. % hexane, the viscosity of the sample reduced to 126 cP. At a temperature of 77° C., when the heavy oil sample was mixed with toluene to form a sample containing 90 wt. % heavy oil and 10 wt. % toluene, the viscosity reduced to 66 cP. The results demonstrate that both solvents, hexane, and toluene, can significantly reduce the viscosity of the heavy oil. Adding 10 wt. % of these two solvents led to more than an 80% reduction in viscosity.

After adding the solvent to the reservoir, in step 110 water is introduced into the reservoir to further reduce the viscosity of the heavy oil. In one or more embodiments, the water is heated so that hot water is injected into the reservoir. Injecting hot water into a reservoir is employed as a thermal technique to further lower the viscosity and increase the mobility of the heavy oil. Generally, the viscosity of oil decreases as the temperature of the oil increases. The hot water is desired in a liquid state to reach deep and thin reservoirs therefore the water is not heated above the boiling point at downhole pressures.

Figure 3:
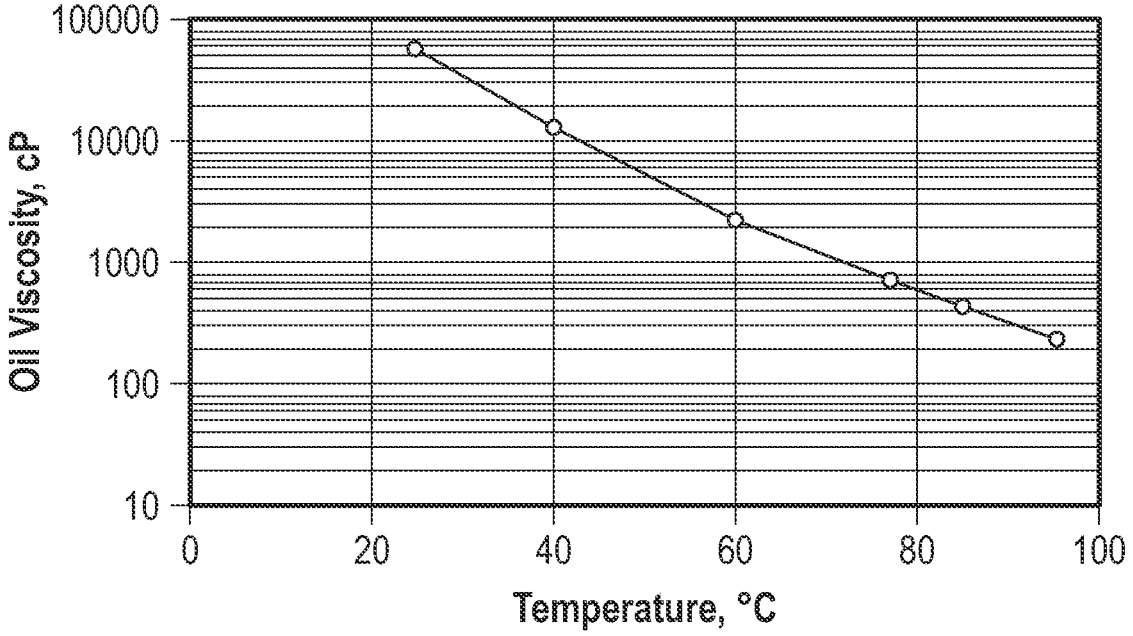
FIG. 3 illustrates a graph showing oil viscosity versus temperature according to one or more embodiments.

In an experiment, the viscosity of a heavy oil sample was measured over a large temperature range. The heavy oil sample used for the experiment was obtained from a carbonate formation from an oil reservoir (also used in FIG. 2). Viscosity measurements of the heavy oil sample were obtained over a range of increasing temperatures from 25° C. to 95° C. The temperature of the subsurface reservoir was assumed to be 77° C. for the experiment. FIG. 3 illustrates the viscosity measurements of the heavy oil sample versus the temperature. At a reservoir temperature of 77° C., the viscosity of the heavy oil sample was 711 cP. When the temperature of the heavy oil sample was increased to 95° C., the oil viscosity reduced to 242 cP. The results from this experiment demonstrate that increasing the temperature of the heavy oil reduces its viscosity. An increase of 18° C. from 77° C. to 95° C. reduced the viscosity by approximately one third of the assumed reservoir oil viscosity. The results also indicate that applying hot water will be effective in reducing the viscosity of heavy oil by increasing the temperature of the heavy oil.

The temperature of the hot water injected into the reservoir may be in a range from 10° C. to about 200° C. above the reservoir temperature, such as from a lower limit of about 10° C., 15° C., 20° C., 25° C., 30° C., 35° C., 40° C., 45° C., or 50° C. above the reservoir temperature, to an upper limit of about 155° C., 160° C., 165° C., 170° C., 175° C., 180° C., 185° C., 190° C., 195° C., or 200° C. above the reservoir temperature. As noted above, it is desired to maintain the hot water as a liquid within the reservoir, and thus an upper limit for injection temperature of the water may depend upon the pressure of the specific reservoir.

Another characteristic of the hot water injected into a reservoir is that hot water tends to flow further down into the lower parts of the reservoir where heavy oil may be located. This improves the overall sweep of the reservoir. The hot water injected into the reservoir will flow into the lower parts even when the permeability of the upper layers is higher than that of the lower layers. This characteristic of hot water injection may be contrasted with characteristics of steam injection. In steam injection, the steam tends to preferentially sweep the upper layers of the reservoir while inefficiently sweeping the lower layers of the reservoir.

In the integrated method of embodiments herein, the hot water is introduced into a reservoir after the solvent has been introduced. The hot water pushes or carries the solvent and facilitates delivery of the solvent further down into the lower layers of the reservoir where the heavy oil may be located. The combined use of solvent and hot water is more efficient in reducing the viscosity of the heavy oil and increasing the mobility, which leads to greater production of the heavy oil. Further, less solvent and less energy input are required to achieve significant oil mobility improvement. It is not economical to fill a reservoir with large volumes of solvent because solvent is expensive. The cost of using very large volumes of solvent would very likely exceed the value of the oil that is produced. A practical method would be to inject a smaller volume of the solvent to displace the oil with the hot water. The cost of adding large volumes of water is minimal as water is readily available and inexpensive. In one or more embodiments, the volume ratio of solvent to hot water is in a range of from about 1:1 to 1:1000.

Even though the introduction of the solvent decreases the viscosity of the heavy oil in the reservoir, the viscosity of the heavy oil is still significantly higher than the viscosity of the hot water introduced into the reservoir. The difference in the viscosities of the hot water and the heavy oil causes viscous fingering to occur. Viscous fingering is a condition where the interface of two fluids bypasses sections of reservoir as it moves along, creating an uneven, or fingered, profile. Viscous fingering is a common condition in oil reservoirs when water is introduced. The result of viscous fingering is an inefficient sweeping action that can bypass significant volumes of recoverable oil and may also cause early breakthrough of water into adjacent production wells.

After adding the hot water to the reservoir, a polymer solution is introduced into a reservoir (step 115). Generally, a polymer used in oil recovery is composed of water-soluble molecules that increase the viscosity of water. Increasing the viscosity of water improves the mobility ratio between the water and the heavy oil leading to an improved sweep efficiency of the reservoir. Additionally, injecting polymer solution into the reservoir may increase the reservoir pressure more effectively than water flooding, especially in heavy oils. This is because the polymer solution reduces the water-cut (water fraction in the total liquid produced). Unlike steam flooding which requires clean water for steam generation, polymer flooding can use lower quality water, therefore it is also less expensive.

Polymer flooding of heavy oil reservoirs is similar to polymer flooding in other types of reservoirs but there are several important differences. Initially, a reservoir is screened to determine if it is suitable for polymer solution injection specifically for the recovery of heavy oil. Some screening characteristics of the reservoir that may be considered are temperature, oil viscosity, mobile oil, permeability, and lithology, among others. For example, the temperature of a particular reservoir is an important measurement in determining which polymer to use because some polymer molecules may degrade at high temperatures while others may not. As an example, hydrolyzed polyacrylamide polymer has been used in polymer flooding at approximately 99° C. and can remain stable at temperatures of over 100° C.

under certain conditions. Also, permeability of a reservoir is another important screening measurement. Highly viscous oil, such as heavy oil, may require high permeability to ensure sufficient injectivity.

Both synthetic polymers and biopolymers may be used in this method. Specific examples of the polymers that may be used are partially hydrolyzed polyacrylamides, copolymers of acylamide and acrylate; copolymers of acrylamide tertiary butyl sulfonate (ATBS) and acrylamides; and copolymers of acrylamide, acrylic acid and ATBS, Xanthan gum and scleroglucan. Mixtures of these polymers may also be used.

Selection of the type(s) and molecular weight(s) of the polymer(s) to be used may depend on the formation conditions and heavy oil properties. The polymer concentration used in this method may be determined by the viscosity of the oil and the specific properties of a particular polymer. In one or more embodiments, the polymer concentration may range from 0.001 wt.. % to 5 wt.. % of the solution. In one or more embodiments the volume ratio of hot water to polymer solution is in a range from about 100:1 to 1:1.

In this method, the oil viscosity is effectively reduced by the combined use of solvent and hot water, while the water viscosity is increased by the polymer injection. Therefore, the oil mobility and sweep efficiency are effectively improved, and heavy oil can be more easily and uniformly displaced towards the production well. Also, the hot water helps quickly deliver the solvent deep into the oil reservoir and less solvent and less energy input are required to achieve significant oil mobility improvement. With the significant oil viscosity reduction, lower polymer concentrations are required and can achieve a favorable mobility ratio, and high injectivity can be achieved in an enhanced and cost-effective manner.

Figure 4:
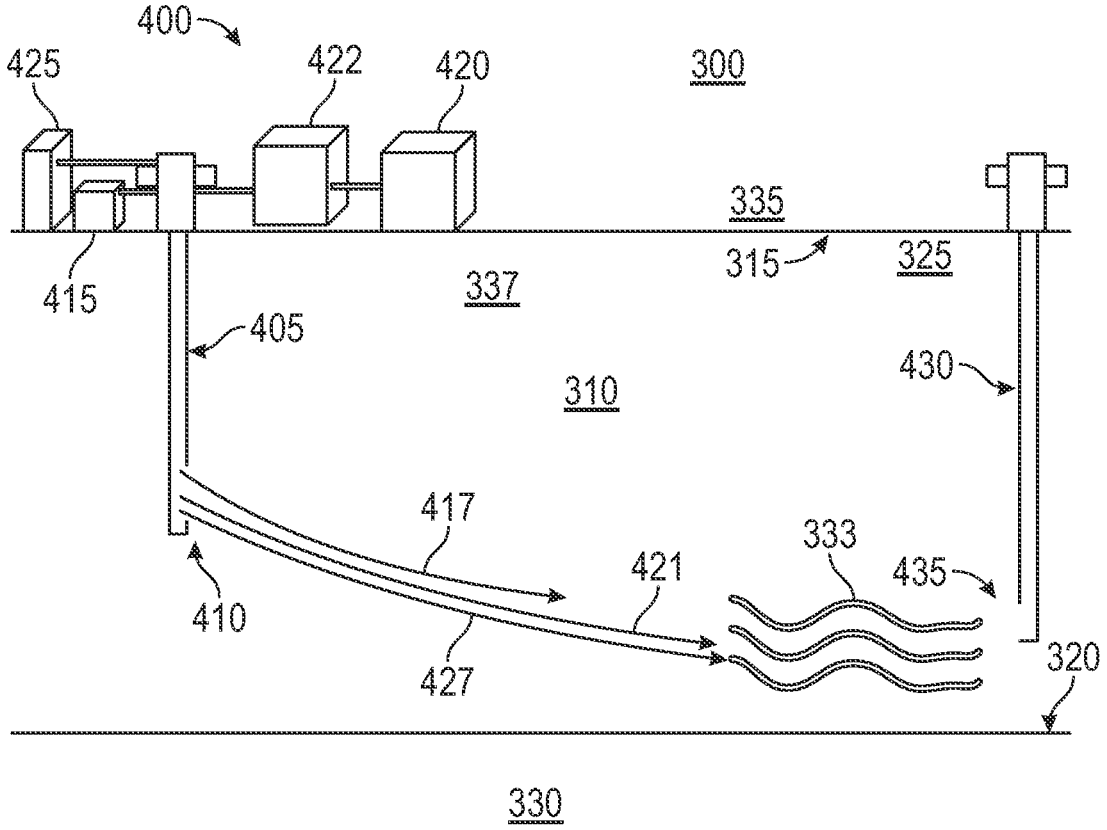
FIG. 4 illustrates a well environment in according to one or more embodiments.

FIG. 4 is a diagram that illustrates a well environment in accordance with one or more embodiments. The well environment 300 includes a surface 335, which represents the surface of the earth. The surface 335 may be located above water, under water, or under ice. Below the surface 335 is the subsurface 337 comprising a reservoir 310 containing heavy oil 333 having a reservoir top 315 and a reservoir bottom 320. Above the reservoir top 315 is a fluid-impenetrable overburden 325, which is part of the well environment 300. Below the reservoir bottom 320 is the underburden 330, which is also part of the well environment 300.

Traversing through subsurface environment is well injection system 400. The well injection system 400 includes an injection well 405 with an injection well bottomhole 410, a solvent storage 415, a water storage 420, a water heater 422 and a polymer solution storage 425. The bottomhole 410 of the injection well 405 is positioned within the reservoir 310. In one or more embodiments, if the underburden 330 is porous or permits fluid migration, the injection well 405 may transverse the reservoir bottom 320 where the injection well bottomhole 410 is positioned in the underburden 330. The well injection system 400 also includes a recovery or production well 430 that is utilized to collect the heavy oil 333. The bottomhole 435 of the production well 430 is positioned within the reservoir 310. The reservoir may be a partially depleted reservoir because other non-heavy oils may have been produced by conventional methods. As such, many characteristics of the reservoir, such as the fracture pressure, may already be known before the present heavy oil recovery method is initiated.

FIG. 4 shows that solvent 417 is dispensed from a solvent storage 415 and introduced into the reservoir 310 through the injection well 405. The solvent 417 traverses into the reservoir 310 for some distance away from the injection well bottomhole 410. After the solvent 417 has been introduced, water is dispensed from a water storage 420 to a water heater 422. The water may be heated to a temperature higher than that of the reservoir but lower than the boiling point of water at the prevailing reservoir pressure. The hot water 421 is further dispensed from the water heater 422 and introduced into the reservoir 310 through the injection well 405. The hot water 421 traverses into the reservoir 310 for some distance away from the injection well bottomhole 410. If desired, prior to heating and hot water injection, the water may be pre-treated to meet the heater requirements and the injection requirements for the specific reservoir, and such water treatment may include filtration, reduction in total dissolved solids (salt removal), and other injection system treatments known to those skilled in the art.

The hot water 421 may push or carry the solvent 417 further down into the reservoir towards the heavy oil 333, especially in deep reservoirs. The hot water 421 and the solvent 417 lower the viscosity of the heavy oil 333, however issues like water fingering lead to inefficient sweep of the reservoir as explained above.

After the hot water 421 has been introduced into the reservoir, a polymer solution 427 is dispensed from a polymer solution storage 425 to the injection well 405. The polymer solution 427 is introduced into the reservoir 310 through the injection well 405 and traverses into the reservoir 310 for some distance away from the injection well bottomhole 410. The polymer solution 427, the hot water 421 and the solvent 417 all interact within the reservoir 310. The polymer increases the viscosity of the water thereby reducing the water fingering and increasing the sweep of the reservoir.

In one or more embodiments, the solvent, hot water, and polymer solution are each injected at a pressure sufficient to promote heavy oil flow towards the production well. However, the pressure should be maintained below the fracture pressure of a formation.

The heavy oil 333 that interacts with the sequential treatment of solvent, hot water and polymer solution has lower viscosity and migrates through the reservoir 310 and towards the production well bottomhole 435. The heavy oil 333 with lower viscosity flows through the production well 430 and is collected and further processed at the surface 335. Water, solvent, and polymer solution is also recovered via the production well, and may be separated from the heavy oil and reused for continued heavy oil production or disposed.

Figure 5:
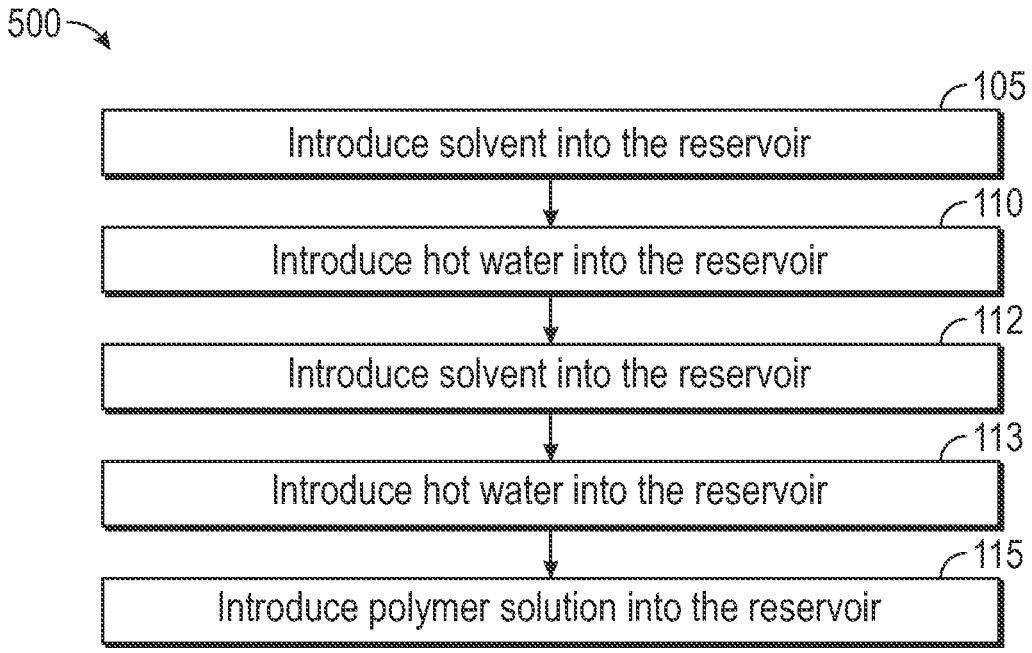
FIG. 5 illustrates a flowchart depicting a sequential method to recover heavy oil according to one or more embodiments.

In one or more embodiments, several cycles of solvent and hot water may be introduced into the reservoir to reduce the viscosity of the heavy oil before the polymer solution is introduced. FIG. 5 shows a flow chart of the integrated method 500 that involves a sequential introduction of solvent into a reservoir 105; the introduction of solvent into a reservoir 105 is followed by the sequential introduction of hot water into the reservoir 110. Optionally, to further lower the viscosity of the heavy oil, another cycle of solvent 112 and hot water 113 are introduced sequentially into the reservoir. Multiple additional sequential cycles of solvent 112 and hot water 113 may be introduced into the reservoir before the polymer solution 115 is finally introduced. In one or more embodiments, the oil viscosity may be measured at the bottom of the injection well to estimate if the heavy oil viscosity has been reduced sufficiently for mobilization by the cycles of solvent 112 and hot water 113, prior to introducing Polymer solution 115. Alternatively or additionally, lab studies may be conducted to estimate the interaction of solvent and hot water injections with the heavy oil to determine a suitable number of solvent-hot water cycles and the optimum slug sizes useful for mobilizing the heavy oil within the formation. Without wanting to be bound by theory, alternating injection of small slugs of solvent and hot water may achieve higher oil recovery than injection of a larger solvent slug followed by hot water flooding, due to the interaction of the solvent with the heavy oil prior to and during heating (hot water injection) cycles. The interaction of the solvent with the oil may be enhanced due to the intermediate hot water injections.

As described above, embodiments herein utilize sequential solvent, hot water, and polymer solution injection to enhance heavy oil mobility and heavy oil recovery from a formation. In some embodiments, multiple cycles of solvent and hot water may be sequentially injected prior to polymer solution injection. Such methods may result in enhanced recovery of heavy oil from reservoirs.

Unless defined otherwise, all technical and scientific terms used have the same meaning as commonly understood by one of ordinary skill in the art to which these systems, apparatuses, methods, processes and compositions belong.

The singular forms "a," "an," and "the" include plural referents, unless the context clearly dictates otherwise.

As used here and in the appended claims, the words "comprise," "has," and "include" and all grammatical variations thereof are each intended to have an open, non-limiting meaning that does not exclude additional elements or steps.

"Optionally" means that the subsequently described event or circumstances may or may not occur. The description includes instances where the event or circumstance occurs and instances where it does not occur.

When the word "approximately" or "about" are used, this term may mean that there can be a variance in value of up to ±10%, of up to 5%, of up to 2%, of up to 1%, of up to 0.5%, of up to 0.1%, or up to 0.01%.

Ranges may be expressed as from about one particular value to about another particular value, inclusive. When such a range is expressed, it is to be understood that another embodiment is from the one particular value to the other particular value, along with all particular values and combinations thereof within the range.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed as new and desired to be protected by Letters Patent of the United States is:

1. A method for retrieving heavy oil from a reservoir, the method comprising:
- providing an injection well traversing a subsurface into a reservoir containing a heavy oil;
- sequentially:
  - introducing a solvent into the reservoir via the injection well;
  - introducing hot water into the reservoir via the injection well; then
  - introducing a polymer solution into the reservoir via the injection well;
- where the sequentially introduced solvent, hot water, and polymer solution fluids intermingle with the heavy oil within the reservoir to form a heavy oil mixture; and
- retrieving the heavy oil mixture from a production well.

2. The method of claim 1, wherein where a volume ratio of solvent to hot water is in a range of from about 1:1 to 1:1000.

3. The method of claim 1, wherein where a volume ratio of hot water to polymer solution is in a range from about 100:1 to 1:1.

4. The method of claim 1, wherein the solvent is selected from a group consisting of pentane, hexane, heptane, naphtha, kerosene, diesel, toluene, C4-C6 alcohols, and mixtures thereof.

5. The method of claim 1, wherein the hot water is heated to a temperature higher than that of the reservoir but lower than a boiling point of water at a prevailing reservoir pressure.

6. The method of claim 1, wherein the hot water is heated to a temperature in a range from about 10° C. to 200° C. above the reservoir temperature.

7. The method of claim 1, wherein a polymer in the polymer solution is in a concentration in a range of from about 0.001 wt.. % to 5.0 wt.. %.

8. The method of claim 1, wherein a polymer in the polymer solution is selected from a group consisting of partially hydrolyzed polyacrylamides, copolymers of acylamide and acrylate, copolymers of acrylamide tertiary butyl sulfonate (ATBS) and acrylamides, copolymers of acrylamide, acrylic acid and ATBS, Xanthan gum, scleroglucan, and mixtures thereof.

9. The method of claim 1, wherein the steps of introducing solvent and introducing hot water are repeated cyclically two or more times before the step of introducing the polymer solution into the reservoir.

10. A method for retrieving heavy oil from a reservoir, the method comprising:
- providing an injection well traversing a subsurface into a reservoir containing a heavy oil;
- sequentially:
  - introducing a solvent into the reservoir via the injection well; and
  - introducing hot water into the reservoir via the injection well;
- estimating the viscosity of the heavy oil in the reservoir based on solvent type, injection volume of solvent, temperature and volume of the hot water, and temperature of the reservoir;
- repeating the sequentially introducing the solvent and the hot water and the estimating until an estimated viscosity of the heavy oil in the reservoir is below a threshold viscosity; and thereafter
- introducing a polymer solution into the reservoir via the injection well;
- where the sequentially introduced solvent, hot water, and polymer solution fluids intermingle with the heavy oil within the reservoir to form a heavy oil mixture;
- retrieving the heavy oil mixture from a production well.

11. The method of claim 10, wherein where a volume ratio of solvent to hot water is in a range of from about 1:1 to 1:1000.

12. The method of claim 10, wherein where a volume ratio of hot water to polymer solution is in a range from about 100:1 to 1:1.

13. The method of claim 10, wherein the solvent is selected from a group consisting of pentane, hexane, heptane, naphtha, kerosene, diesel, toluene, C4-C6 alcohols, and mixtures thereof.

14. The method of claim 10, wherein the hot water is heated to a temperature higher than that of the reservoir but lower than a boiling point of water at a prevailing reservoir pressure.

15. The method of claim 10, wherein the hot water is heated to a temperature in a range from about 10° C. to 200° C. above the reservoir temperature.

16. The method of claim 10, wherein a polymer in the polymer solution is in a concentration in a range of from about 0.001 wt.. % to 5.0 wt.. %.

17. The method of claim 10, wherein a polymer in the polymer solution is selected from a group consisting of partially hydrolyzed polyacrylamides, copolymers of acylamide and acrylate, copolymers of acrylamide tertiary butyl sulfonate (ATBS) and acrylamides, copolymers of acrylamide, acrylic acid and ATBS, Xanthan gum, scleroglucan, and mixtures thereof.

* * * * *